US005967552A

United States Patent [19]

Roderick et al.

[11] Patent Number: 5,967,552

[45] Date of Patent: Oct. 19, 1999

[54] IN-LINE WHEELED SKATE

[75] Inventors: John A. Roderick, Scituate; David R. Willis, Wakefield, both of R.I.

[73] Assignee: Mearthane Products Corporation, Cranston, R.I.

[21] Appl. No.: 09/148,589

[22] Filed: Sep. 4, 1998

Related U.S. Application Data

[63] Continuation-in-part of application No. 08/731,249, Oct. 11, 1996, Pat. No. 5,836,591.

[51] Int. Cl.[6] ..... A63C 17/06

[52] U.S. Cl. ..... 280/843; 280/11.22; 280/11.23; 280/11.27; 301/5.3

[58] Field of Search ..... 280/11.22, 11.19, 280/11.23, 842, 843, 11.27, 11.28, 809, 811, 87.042; 301/5.3

[56] References Cited

U.S. PATENT DOCUMENTS

| | | | |
|---|---|---|---|
| 1,332,702 | 3/1920 | Wisniewski . | |
| 3,522,951 | 8/1970 | Tyson . | |
| 3,936,061 | 2/1976 | Wada . | |
| 4,076,263 | 2/1978 | Rand | 280/843 |
| 4,618,158 | 10/1986 | Liberkowski . | |
| 5,207,454 | 5/1993 | Blankenburg et al. | 280/843 |
| 5,566,058 | 10/1996 | Sinelnikov . | |
| 5,716,074 | 2/1998 | Theodorou | 280/843 |

FOREIGN PATENT DOCUMENTS

WO 93/20912 10/1993 WIPO .

*Primary Examiner*—J. J. Swann
*Assistant Examiner*—Michael Mar
*Attorney, Agent, or Firm*—Fish & Richardson P.C.

[57] ABSTRACT

An in-line wheeled skate which includes one or more rollers located between the wheels and above the ground plane, thereby enabling the skater to jump up on a rail (or other supporting surface) and roll down the rail sideways, as in 'extreme skating' maneuvers, by placing the skate on the rail with the rollers bearing upon the rail surface. The rollers may be, for example, cylindrical or spherical, and are preferably located between left and right side planes of the skate wheels.

17 Claims, 17 Drawing Sheets

IN-LINE WHEELED SKATE

CROSS REFERENCE TO RELATED APPLICATIONS

This is a continuation-in-part of application Ser. No. 08/731,249 filed on Oct. 11, 1996, now U.S. Pat. No. 5,836,591.

BACKGROUND OF THE INVENTION

The most competent or daring who use in-line roller skates perform acrobatic maneuvers. Some of the more difficult maneuvers, commonly referred to as 'extreme skating', include sliding sideways down a stair bannister rail or similar structure. The skater jumps onto a stair bannister with his skates sideways on the bannister, the bannister rail positioned under the skate frame between the second and third wheels of a four-wheeled skate. In this position, the skater slides, standing on the skates, down the rail. As this motion is substantially parallel to the axes of the wheels, the skater is essentially skidding, instead of rolling, down the railing. In popular vernacular, they are 'grinding'. In some instances, the skaters use existing rails found in public places and in other instances railings are constructed specifically for this use.

To accommodate extreme skating, it is common to install 'grinding plates' to the sides of the roller frame between the second and third rollers. These plates commonly are scalloped to accept a curved rail surface, and provide a wear surface against the bannister. The concave shape of the plate helps the skater to stay on the railing and it also prevents damage to the skate.

As a form of recreation, it is desired to reduce risk while the most avid extreme skaters desire higher speeds within safe limits and the ability to perform a greater variety of feats.

SUMMARY OF THE INVENTION

We have realized that grinding plates provide undesirable characteristics and that good performance can be achieved by employing a rolling member or members to engage the rail, and that it is possible to provide such a feature in a practical manner in a skate that can otherwise perform satisfactorily. In addition, this invention may improve the safety of extreme skating in certain aspects by the addition of the rolling element, avoiding the excessive wear and consequential breakage of grinding plates, which can cause accidents.

According to one aspect of the invention, an in-line wheeled skate has an elongated frame, two wheels and two rollers. The frame extends in a longitudinal direction of travel of the skate, and the two wheels, adapted to roll in the longitudinal direction of the frame upon a ground plane defined by lowermost portions of the wheels, are positioned in-line along the frame. The two rotatable rollers are positioned between the wheels and disposed completely above the ground plane of the wheels, the rollers both having outer engagement surfaces configured for simultaneous rolling contact with a single elongated supporting surface extending transversely between the two wheels. Thus, the skate is adapted to roll upon both rollers along the supporting surface in a direction extending perpendicular to the longitudinal direction of its frame.

In some embodiments, a third roller is positioned between the wheels and disposed completely above the ground plane of the wheels, all three rollers having outer engagement surfaces configured for simultaneous rolling contact with a single elongated supporting surface extending transversely between the two wheels.

In some cases, the rollers are elongated and are of circular cross-section. For example, the rollers may be cylindrical or be contoured to conform to the outer surface of the supporting surface. Preferably, the elongated rollers are each adapted to rotate about individual axes disposed between left and right longitudinal side planes defined by left and right lateral sides of the wheels.

In some other cases, the rollers are spherical. Preferably in these cases, the centers of the spherical rollers are disposed between left and right longitudinal side planes defined by left and right lateral sides of the wheels.

In some embodiments, the rollers are centered between left and right longitudinal side planes defined by left and right lateral sides of the wheels.

Some skates constructed according to the invention have four wheels, the rollers being disposed between a central pair of the wheels.

In some instance, the skate also includes a brake adapted to bear against at least one said roller to resist rotation of the roller.

Other features and advantages will also be understood from the drawing, description and claims.

DESCRIPTION OF EMBODIMENTS

Figure 1:
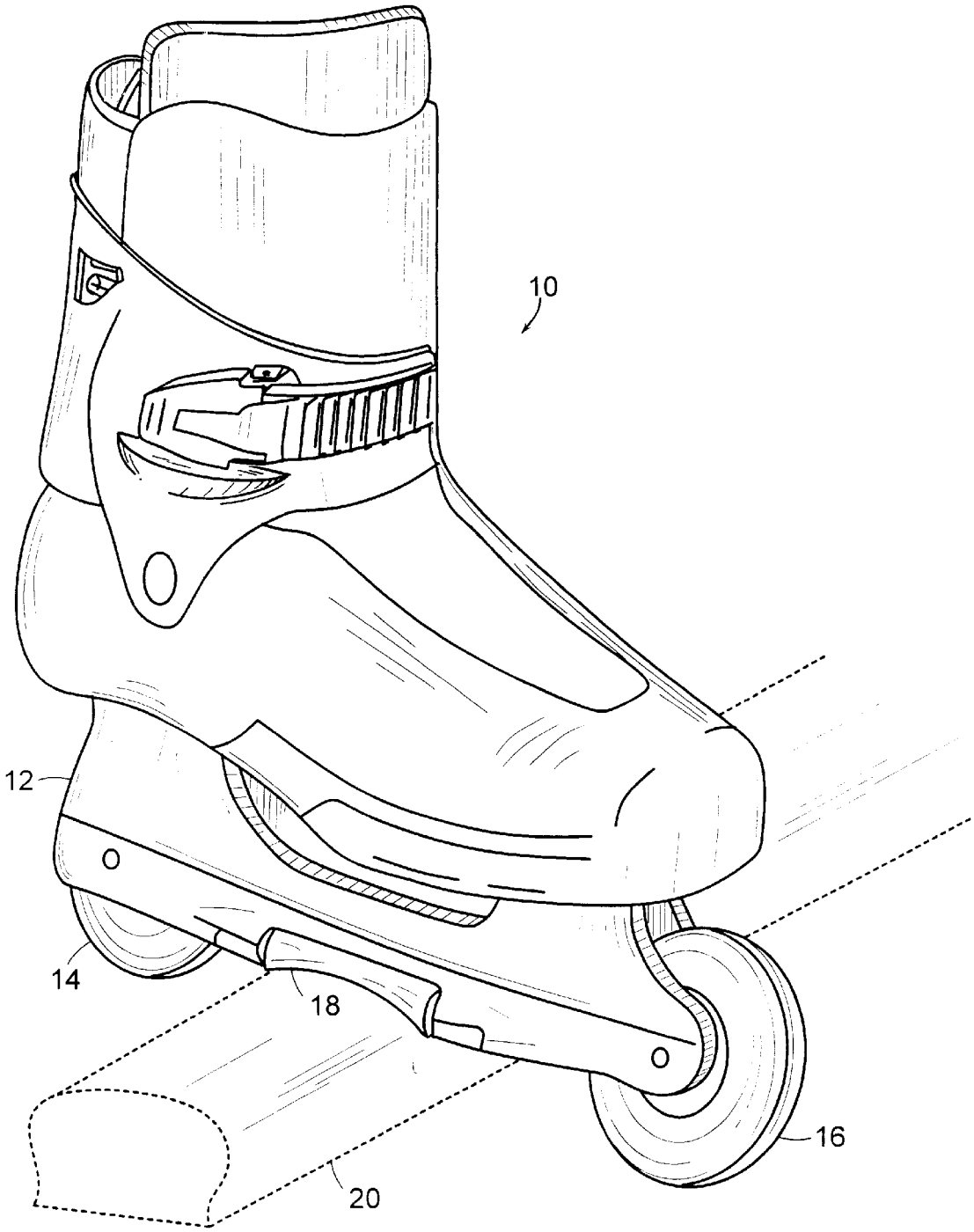
FIG. 1 is a perspective view of an in-line wheeled skate.
Figure 2:
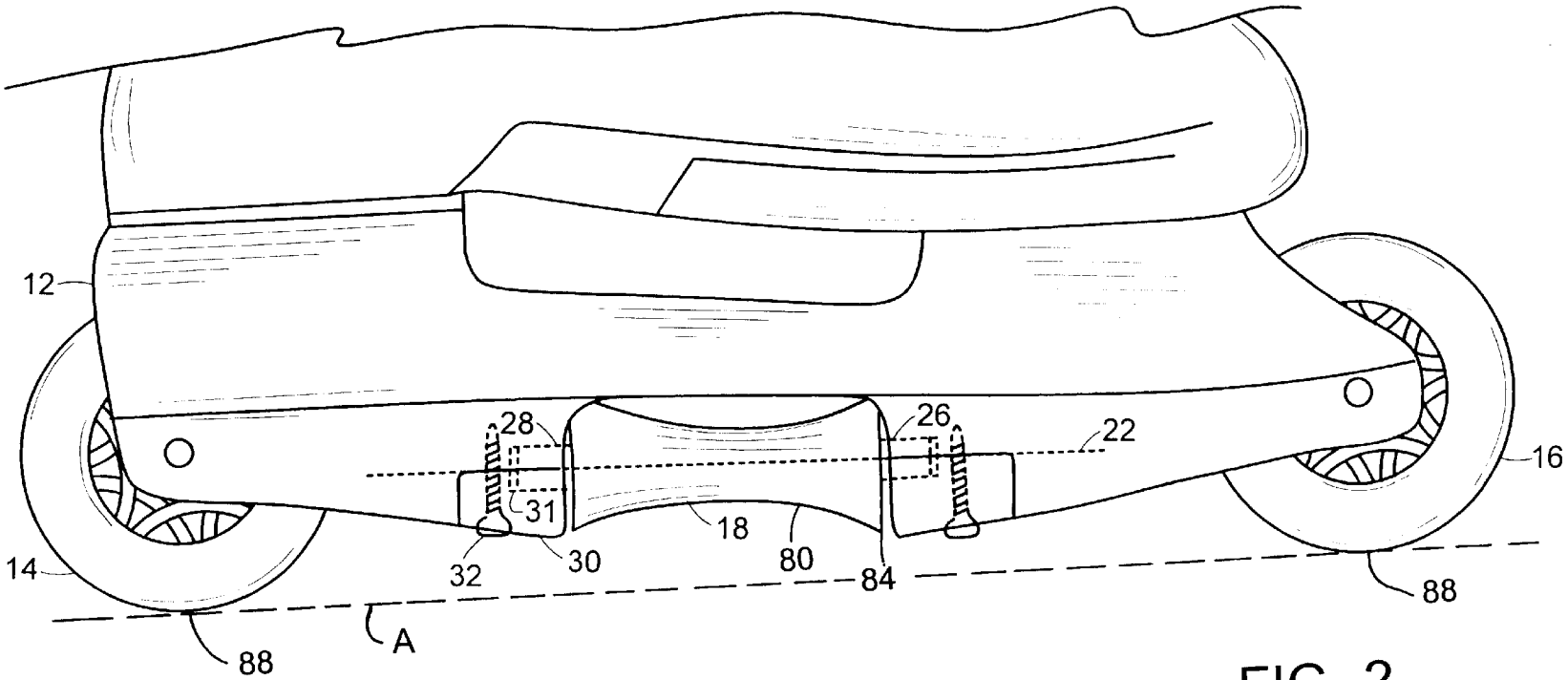
FIG. 2 is a side elevation of the skate of FIG. 1.

Referring first to FIGS. 1 and 2, a rotatable elongated roller 18 is mounted to a wheel frame 12 between two in-line mounted wheels 14 and 16 to allow the skater to roll, rather than skid, sideways along a rail 20. In this example, the inner two wheels of a standard four wheel configuration have been removed to provide room for the roller 18. The roller as shown has a concave outer surface to help to keep the skater centered on the rail. The elongated roller may also be substantially cylindrical.

The roller 18 has an axis 22 of rotation perpendicular to the axes 24 of rotation of the wheels 14 and 16, so that the skate can still function as a normal in-line skate with the wheels in loaded contact with the pavement, yet additionally to enable the skate to roll down a rail upon the roller 18 with the wheels not under load. Two load-bearing end shafts 26 and 28 define the axis 22 of rotation of the roller. The shafts are confined by roller clips 30 attached to the frame 12 with fasteners 32 to define cavities 31 between the clips and the frame. The fasteners and clips can be removed to replace the roller. The shafts 26 and 28 transfer the force of contact with the rail to the skate frame 12.

As shown in FIG. 2, elongated roller 18 is positioned between wheels 14, the roller being mounted to frame 12 for rotation about a single axis 22 extending in the longitudinal direction of the frame. Roller 18 has an outer engagement surface 80 configured for rolling contact with an elongated supporting surface (e.g., a rail 20, FIG. 1) extending transversely between wheels 14 for permitting the skate to travel in a direction extending perpendicular to the longitudinal direction of the frame. The lowermost portion 84 of the outer engagement surface 80 of the roller is positioned vertically higher than a ground plane "A" defined by lowermost portions 88 of wheels 14.

Figure 3:
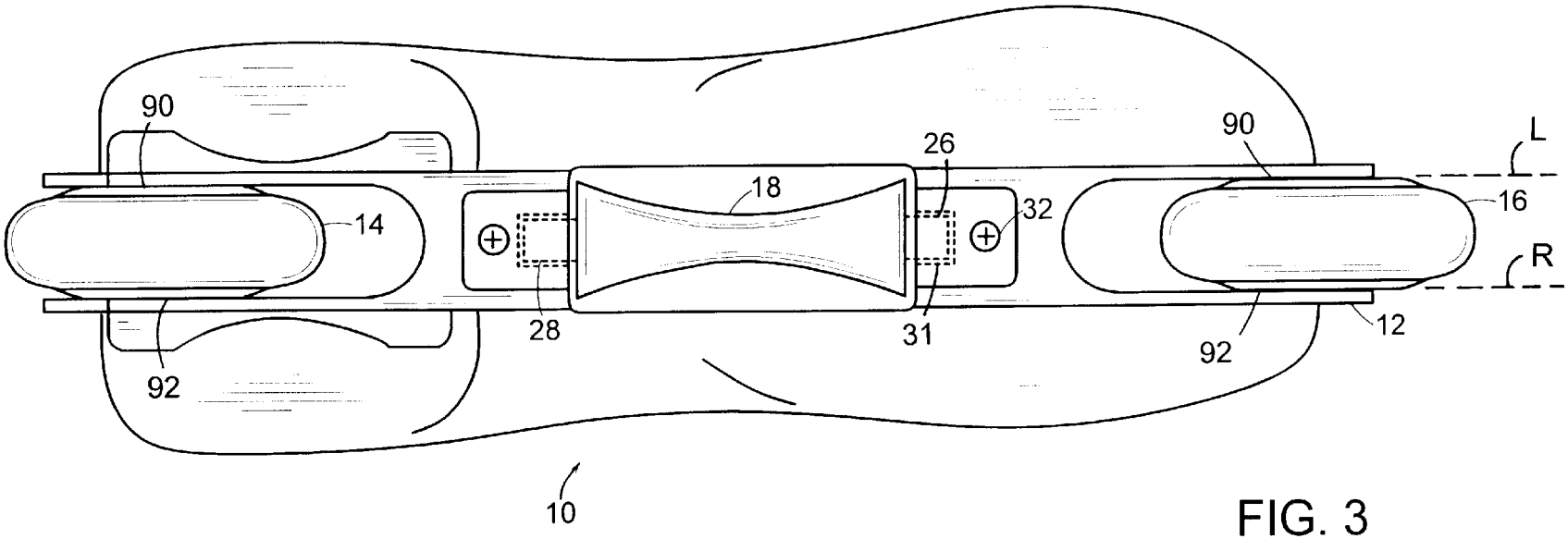
FIG. 3 is a bottom view of the skate of FIG. 1.

As shown in FIG. 3, the rotational axis of the roller is disposed between left and right longitudinal side planes "L" and "R" defined by left and right lateral sides 90 and 92 of wheels 14. In this embodiment, roller 18 is shown with its rotational axis substantially centered between the left and right longitudinal side planes of the wheels.

In some instances the clip fasteners 32 are constructed to be adjustably tightened to provide a desired amount of drag against shafts 26 and 28 within cavities 31 to serve as brakes to slow the speed of the roller by friction for situations where such friction is advantageous.

Figure 4:
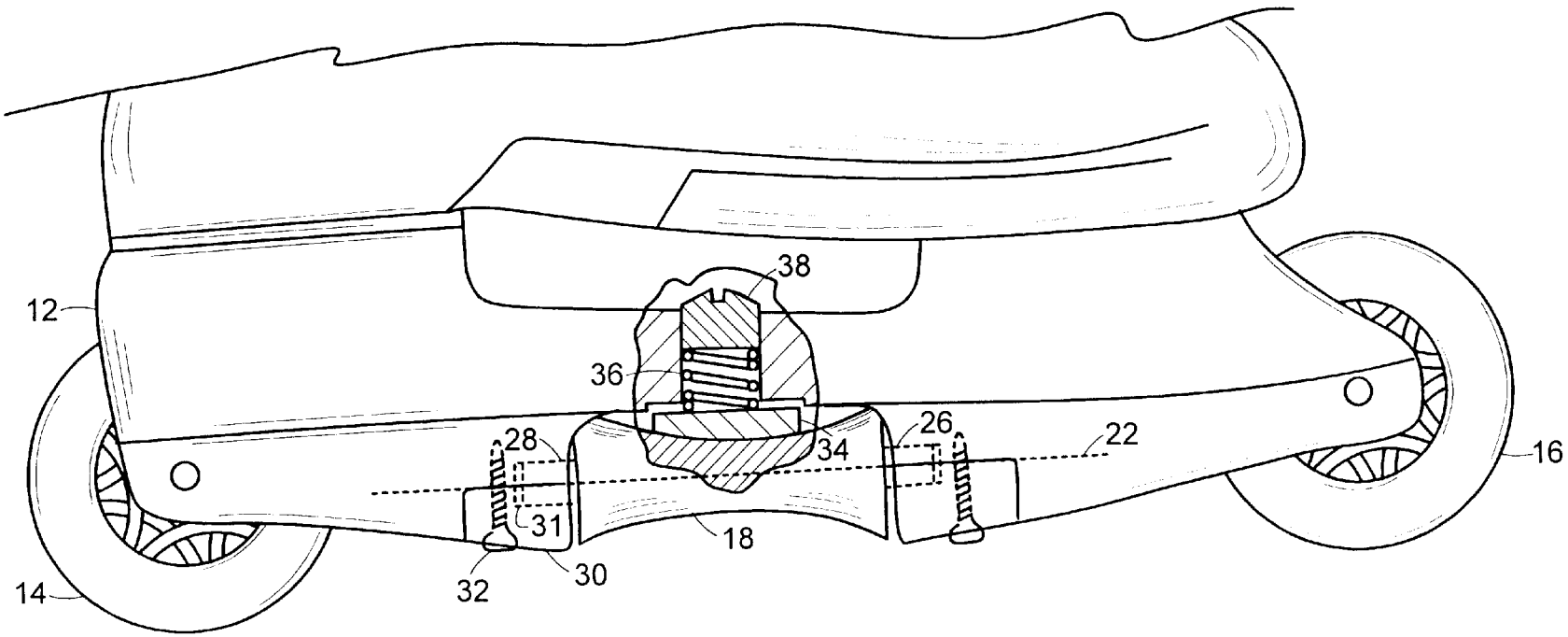
FIG. 4 illustrates a means of braking the roller of the skate of FIG. 1.

In other preferred configurations, a separate brake 34 is provided above the roller, as shown in FIG. 4, to slow the speed of the skater along the rail. The brake is held against the roller by a brake spring 36. The nominal force of the spring 36 against the brake 34, and therefore the brake force, is adjustable by turning a threaded set screw 38 against the spring. In this manner the amount of braking is adjustable according to the skater's preference and personal skill level. As with the rolling element 18, the brake 34 is replaced when worn by removing clips 30.

In some instances the roller 18 and brake 34 are housed in a separate roller housing 40 that is attachable to the frame of an existing four-wheel in-line skate by removing the inner two wheels and attaching the roller housing to the skate frame with fasteners 42.

Figure 5:
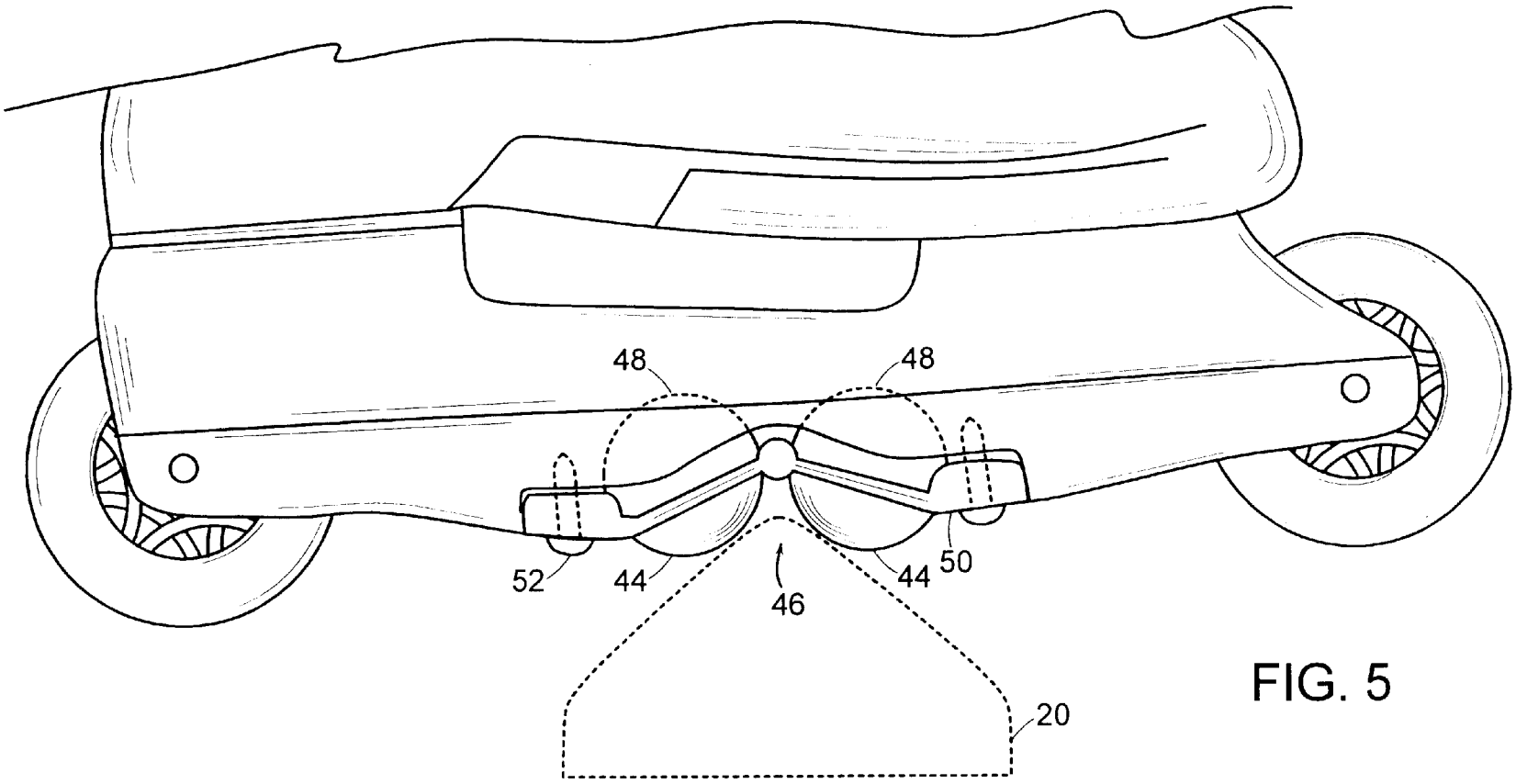
FIGS. 5 and 6 are a side elevation and a bottom view, respectively, of a skate with two spherical rollers.
Figure 6:
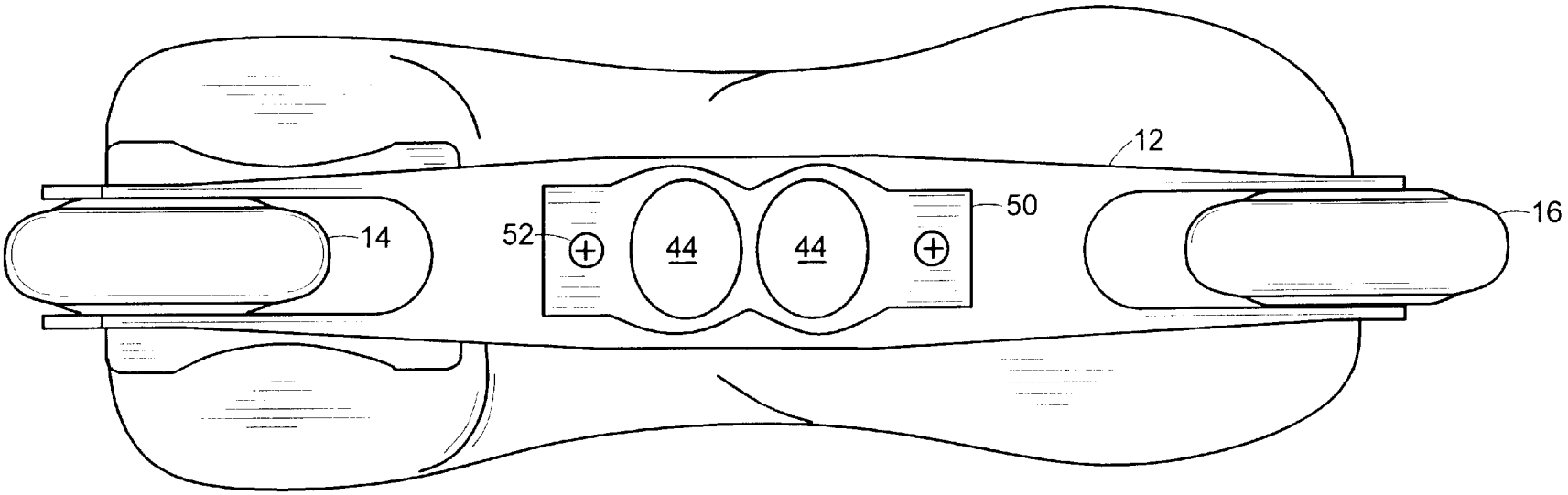

In another embodiment, illustrated in FIGS. 5 and 6, two spherical (or in other cases, egg-shaped or oval) roller balls 44 are employed in place of the cylindrical roller 18. In this case, the skater jumps onto the rail such that the rail 20 is positioned in the area between the two roller balls, as shown. The effective groove or indentation 46 defined between the balls helps to keep the skater positioned on the rail. The roller balls are held against cup-shaped seats 48 by a retaining clamp 50. The seats are preferably formed in the skate frame. The force that the clamp applies to push the balls against the seats is adjustable by tightening the pair of clamp mounting screws 52 to adjust the amount of braking.

As shown, the roller balls 44 are recessed from the contact plane defined by the contact of the outer two wheels with the pavement. Spherical roller balls 44, in other cases, may be mounted lower such that they provide additional support against the pavement for forward motion, as well as sideways motion on a rail, and in certain instances, enable sideways motion on a flat surface while the outer wheels slide or grind.

Figure 7:
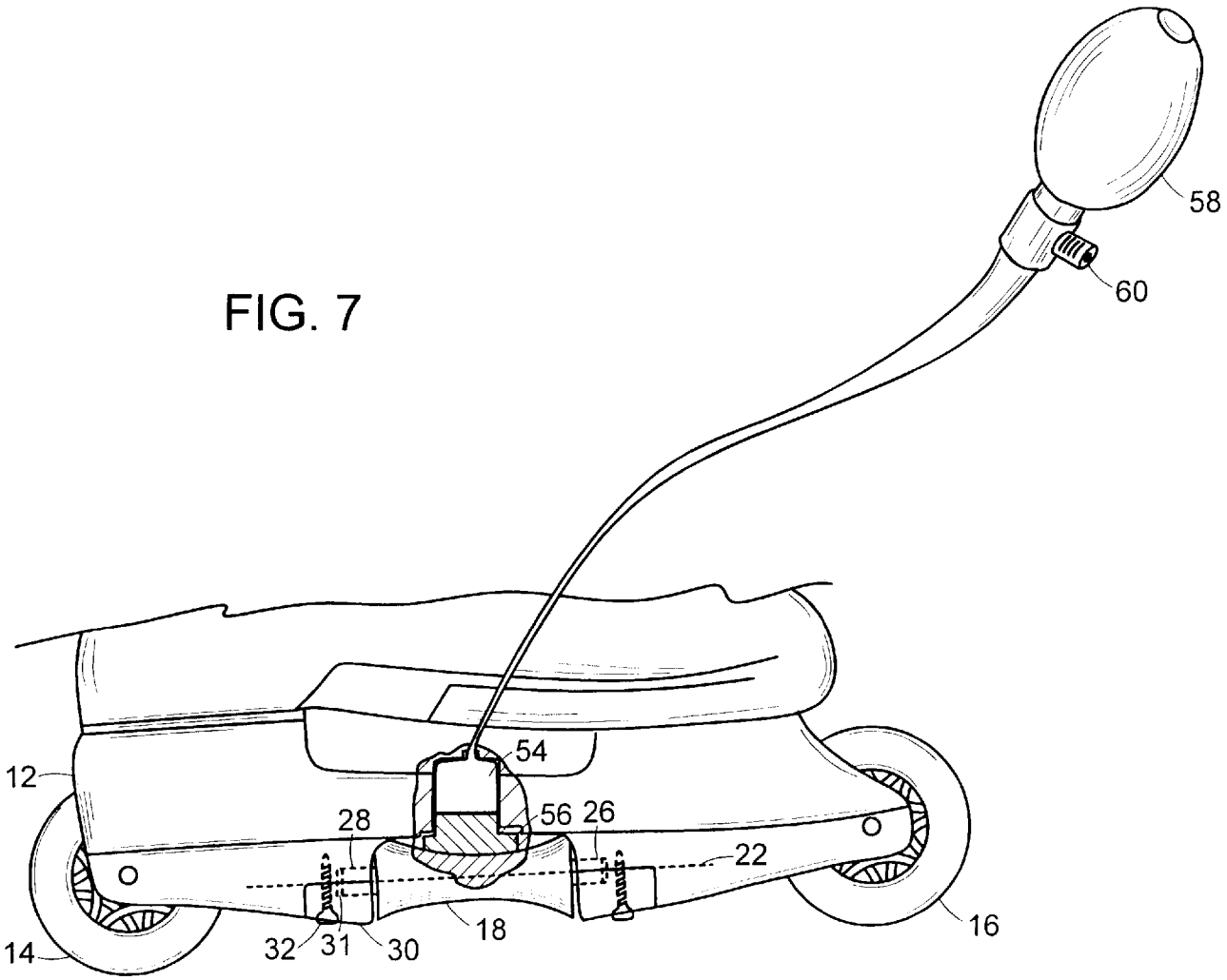
FIG. 7 illustrates an adjustable pneumatic roller brake.

In another instance the braking force is dynamically manipulatable by the skater while skating. The brake force is transferred by fluid pressure, as is schematically illustrated in FIG. 7. A pneumatic or hydraulic cylinder 54 applies pressure to a brake 56 in contact with the roller 18 in response to fluid pressure in the cylinder. The fluid pressure in this essentially closed system is adjustable by a remote manually operated pump, such as a squeeze-bulb 58, and a manually operated bleed valve 60. When the skater wants to increase braking, squeezing the bulb 58 increases the force of the brake against the roller. When it is desired to reduce braking, the valve 60 is opened temporarily to relieve pressure.

In another embodiment, the braking force is modulated in a dynamic manner by continual regulation of the pressure in the squeeze bulb 58 or other pressure transfer device.

Figure 8:
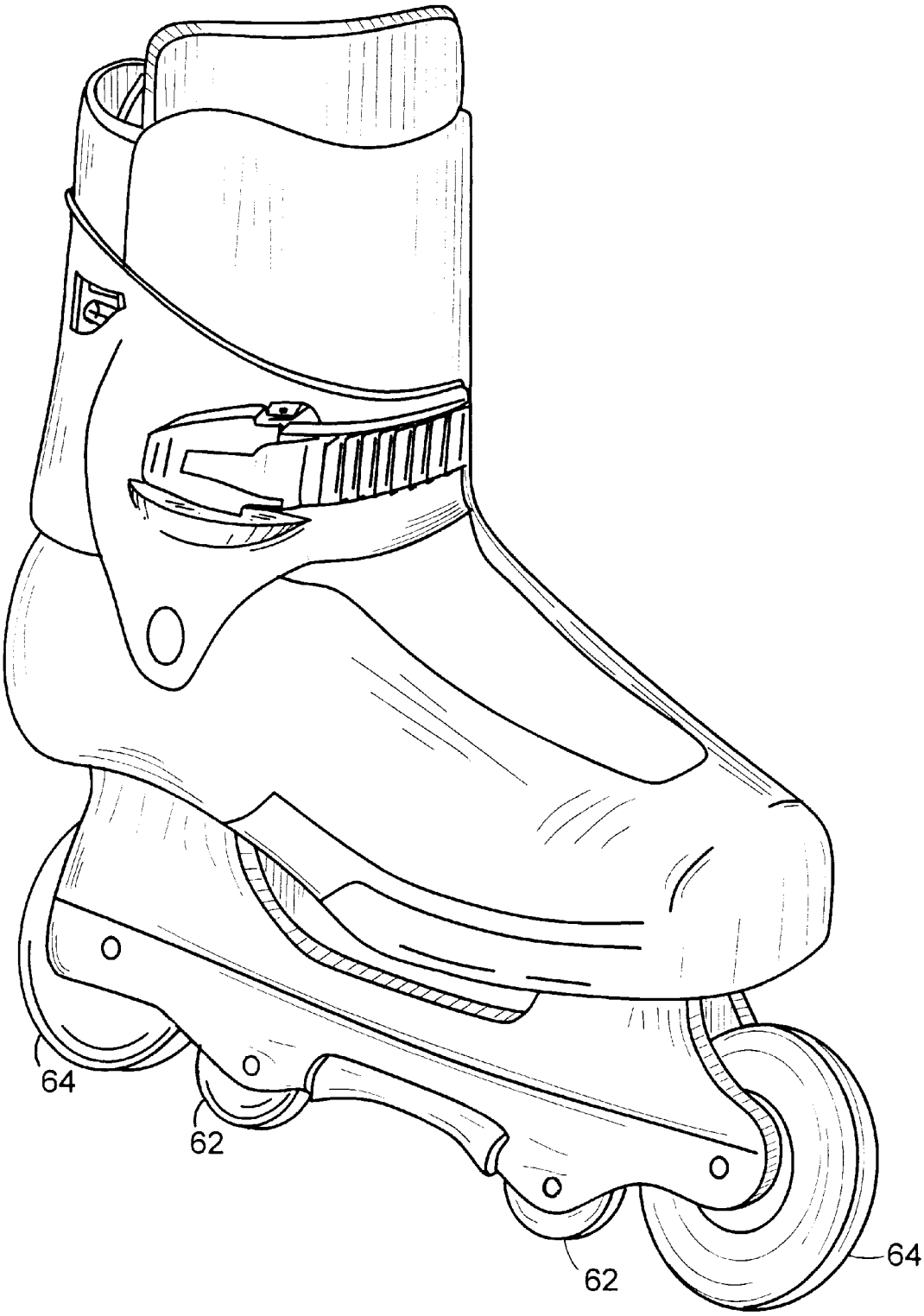
FIG. 8 is a perspective view of a so-called "extreme skate", with four forward wheels and a center roller.
Figure 9A:
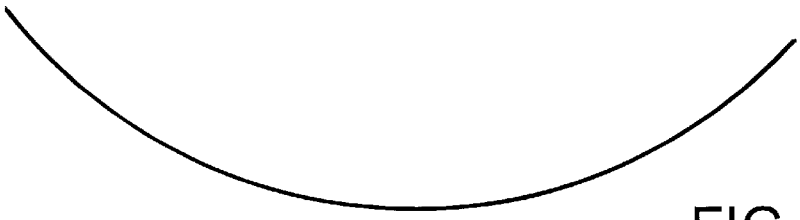
FIGS. 9A–9F illustrate some rail configurations on which the skate of the present invention may be used.
Figure 9B:
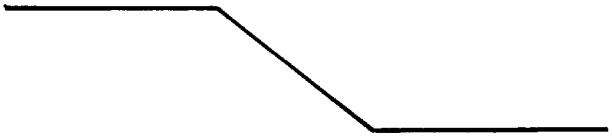
Figure 9C:
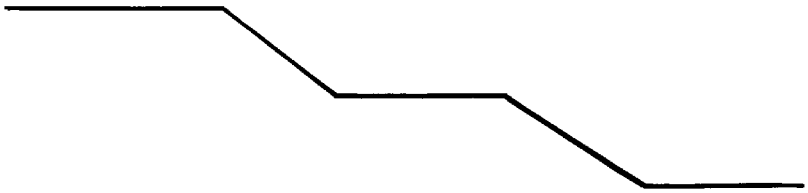
Figure 9D:
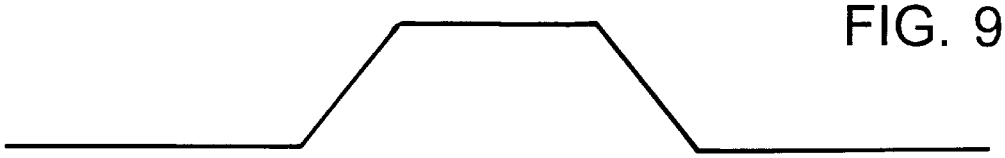
Figure 9E:
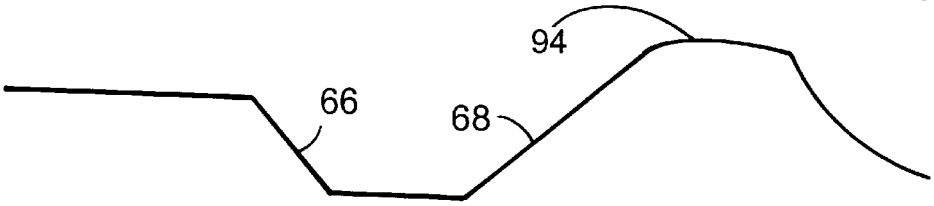
Figure 9F:
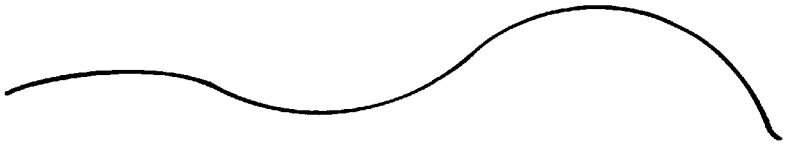

In another configuration referred to as 'extreme skates', the inner two wheels 62 of a four-wheel in-line skate are smaller than the outer two wheels 64, leaving room between the inner two wheels to incorporate the roller, as shown in FIG. 8.

FIGS. 9A–9F illustrate some rail configurations on which the skate of the present invention may be used. The roller slide design allows the skater to slide in a more upright position, as explained further below with respect to FIG. 17. Previous designs require the skater to lean onto the side or edge of the skate. A more upright skating stance provides the skater more maneuverability. This may add to the tricks the skater can perform. Transitions from different inclines become possible. The rail configuration of FIG. 9E includes a curved horizontal plane 94.

The lower friction of the rolling element(s), as compared to the friction of a grinding plate, increases the range of rail speeds achievable with in-line skates, making it possible to perform on rails of more varied form. With the roller device of this invention, a skater can experience rides comparable to roller coaster rides, as the skater goes along the curves and angles on the railings illustrated in FIGS. 9A–9F. Because of electively reduced braking, the momentum of the skater is preserved during a "down run" 66 to enable a following "up run" 68 and so on, thus extending the ride, thrill and enjoyment of extreme skating maneuvers. Sliding down the types of rail configurations shown in FIGS. 9A–9F, including up inclines, is not practical or achievable with grinding plates because they develop too much friction and thus excessively degrade the forward momentum of the skater.

Figure 10:
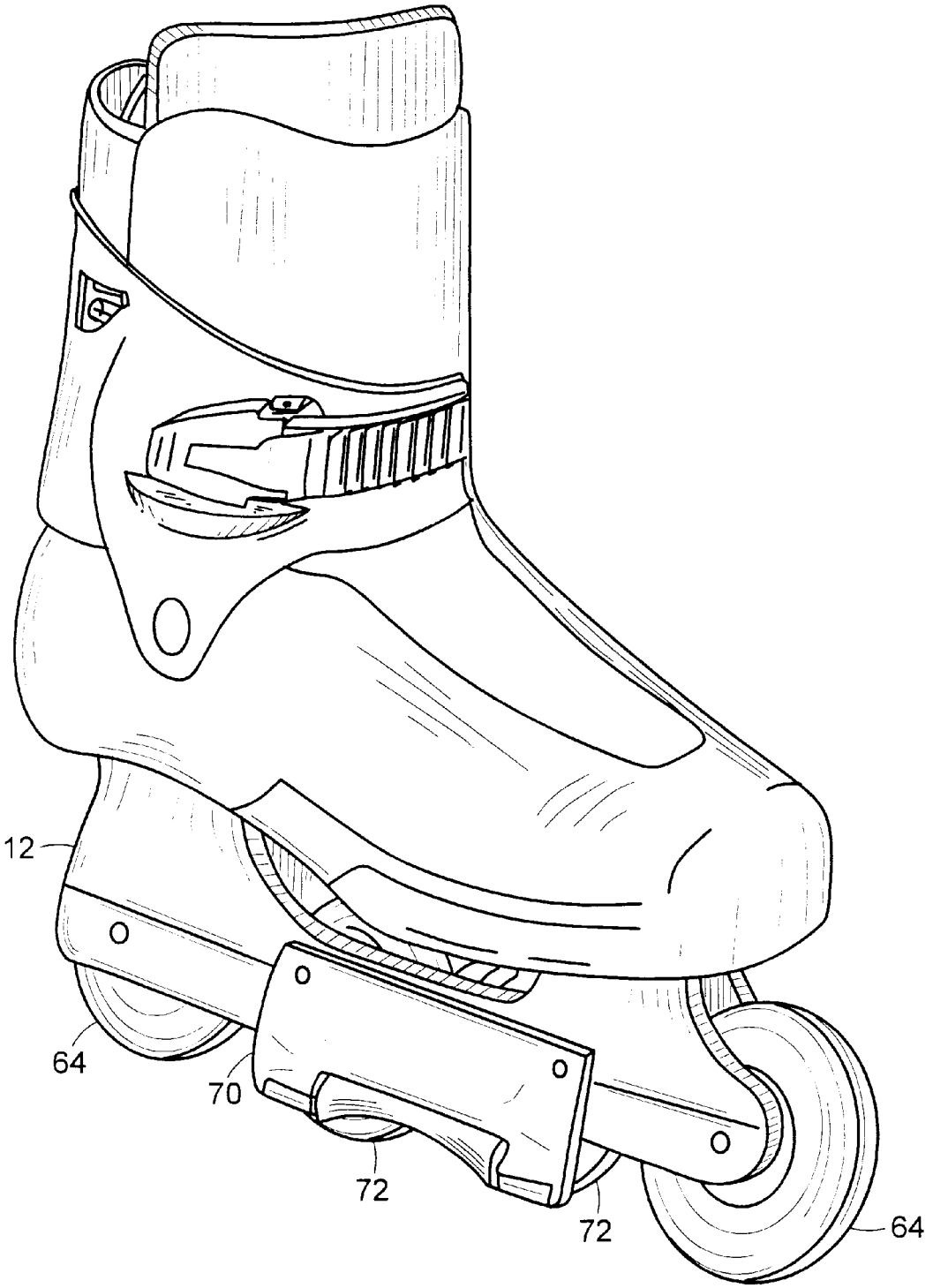
FIG. 10 illustrates an attachment for an in-line skate.
Figure 11A:
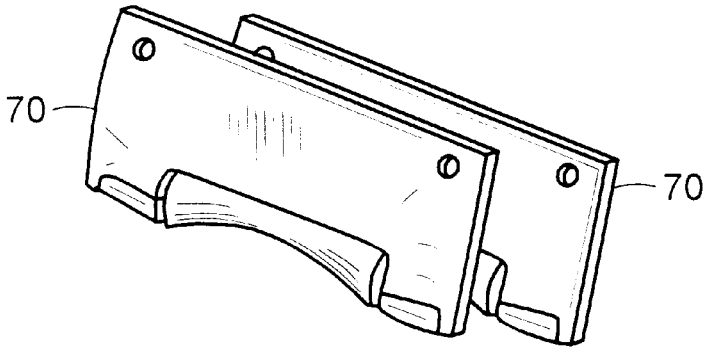
FIGS. 11A through 11C show various embodiments of the attachment shown in FIG. 10.

Referring to FIGS. 10 and 11A–11C, the rolling element may be provided as part of an attachment that is constructed to be secured to an in-line skate. In this manner, the benefits of the invention may be derived with skates not originally designed or built with "extreme skating" in mind, as well as in skates designed for conventional and extreme skating, by use of the attachment. As illustrated in FIGS. 10 and 11A, the attachment 70 is secured in a load bearing relationship to the lower structure, such as the wheel frame 12, of an in-line skate. The rolling element(s) in this case, of either elongated or spherical form, are mounted to one side or both of the frame to provide clearance for the wheels.

Figure 11B:
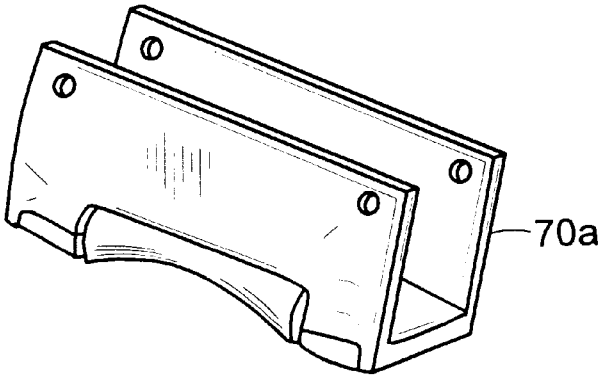
Figure 11C:
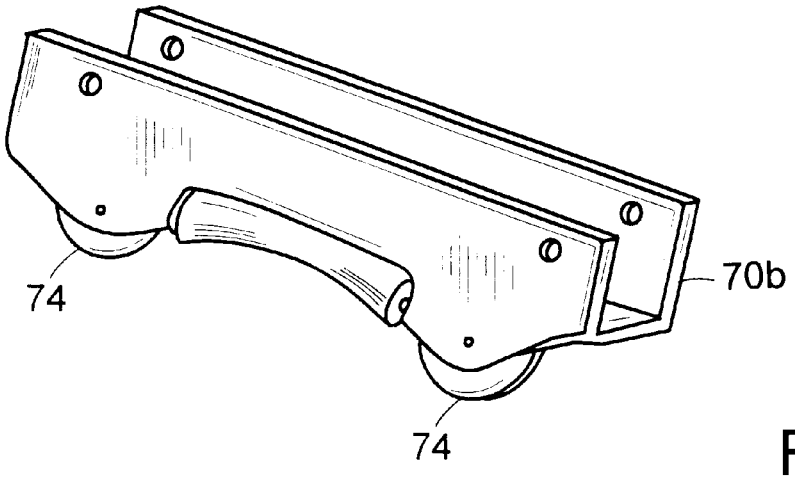

In other embodiments, two of which are illustrated in FIGS. 11B and 11C, the attachment **70*a* or 70*b*, respectively, replaces the centrally located wheels 72, the rolling element preferably being positioned in-line with the skate wheels. In the embodiment shown in FIG. 11C, the attachment includes relatively small wheels 74**, also in-line with the skate wheels, to replace the removed center wheels.

Figure 12:
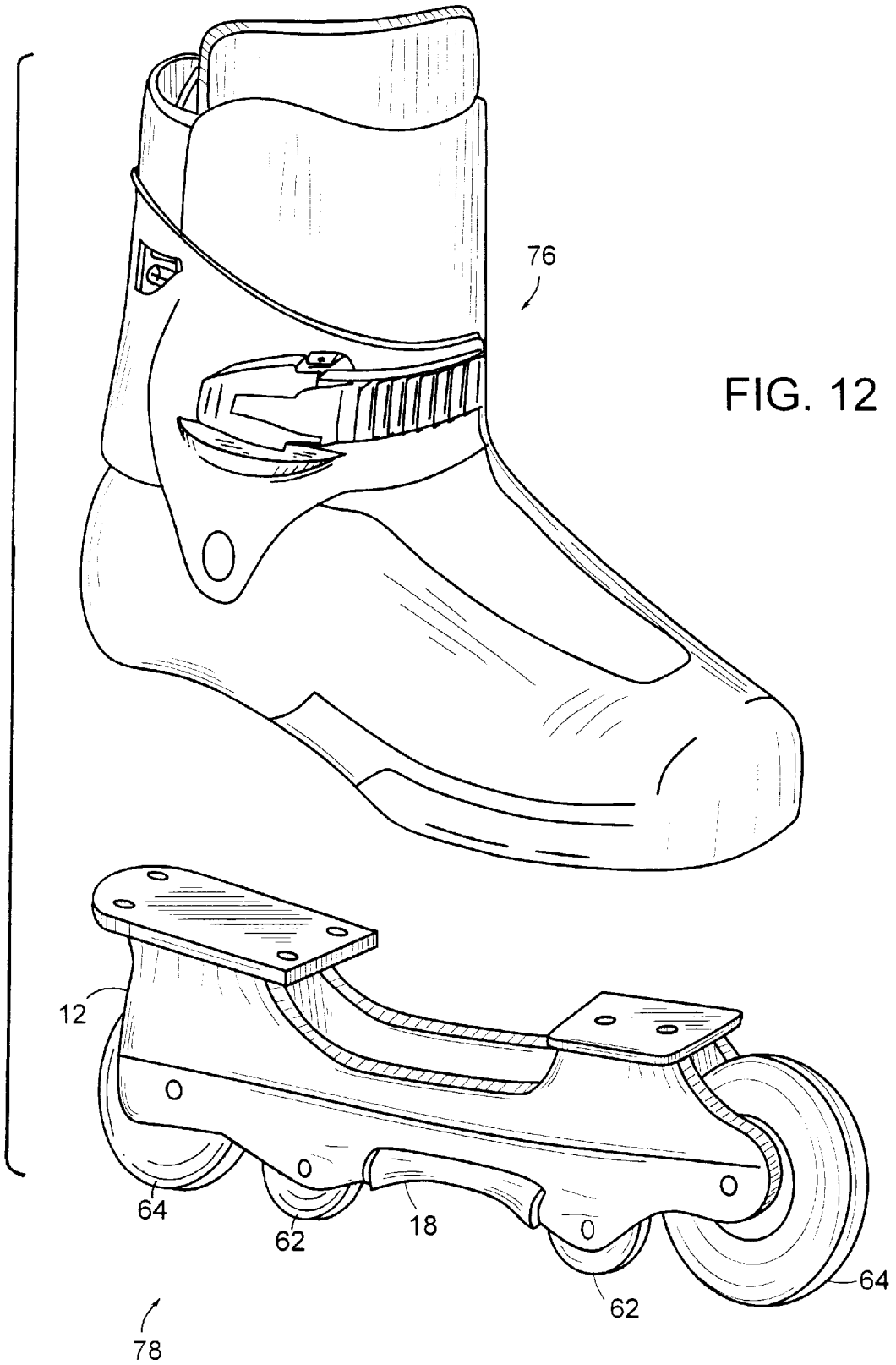
FIG. 12 is a perspective view of a lower structure and a boot portion of an in-line skate.

As shown in FIG. 12, the rolling element may be provided as part of an entire lower structure 78 that includes a skate frame 12, wheels 64 and rolling element 18. The lower structure is securable to the boot portion 76 of an in-line skate, and may be used with boot portions not originally designed or built with extreme skating in mind.

Figure 13:
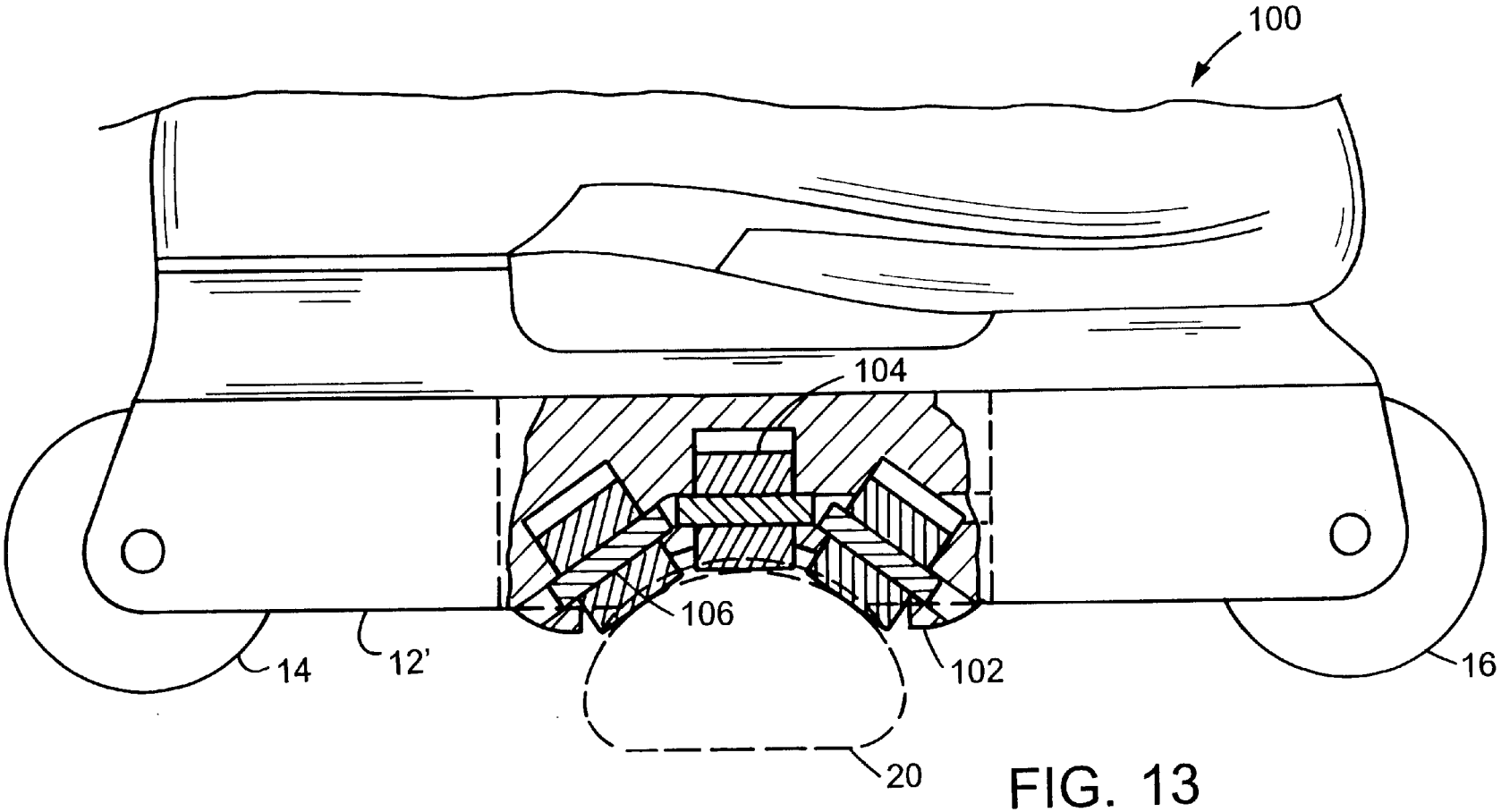
FIG. 13 is a side elevation of a skate with a portion cut away to show three cylindrical rollers.
Figure 14:
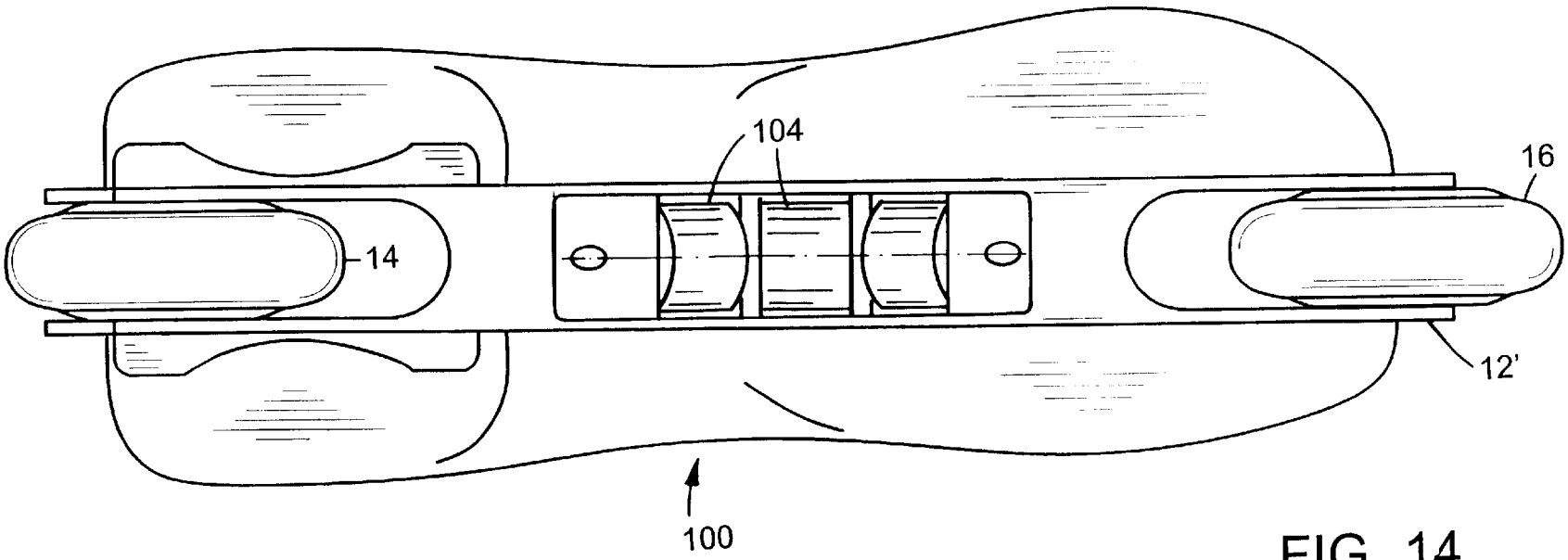
FIG. 14 is a bottom view of the skate of FIG. 13.

Referring to FIGS. 13 and 14, skate 100 has a lower frame 12', supporting two in-line wheels 14 and 16. Mounted within a cavity at the center of the frame is a roller block 102 supporting three elongated, cylindrical rollers 104 adapted to freely rotate upon individual shafts 106. The lower edge of the frame extending along the sides of block 102 is scalloped to provide clearance to rail 20, upon which all three rollers 104 may simultaneously bear in rolling contact. Block 102 may be formed of high stiffness polymer or metal, into which shafts 106 are pressed. Any one or more of rollers 104 may be braked, such as by braking means as shown in FIGS. 4 or 7, to provide additional friction, if desired.

Figure 15:
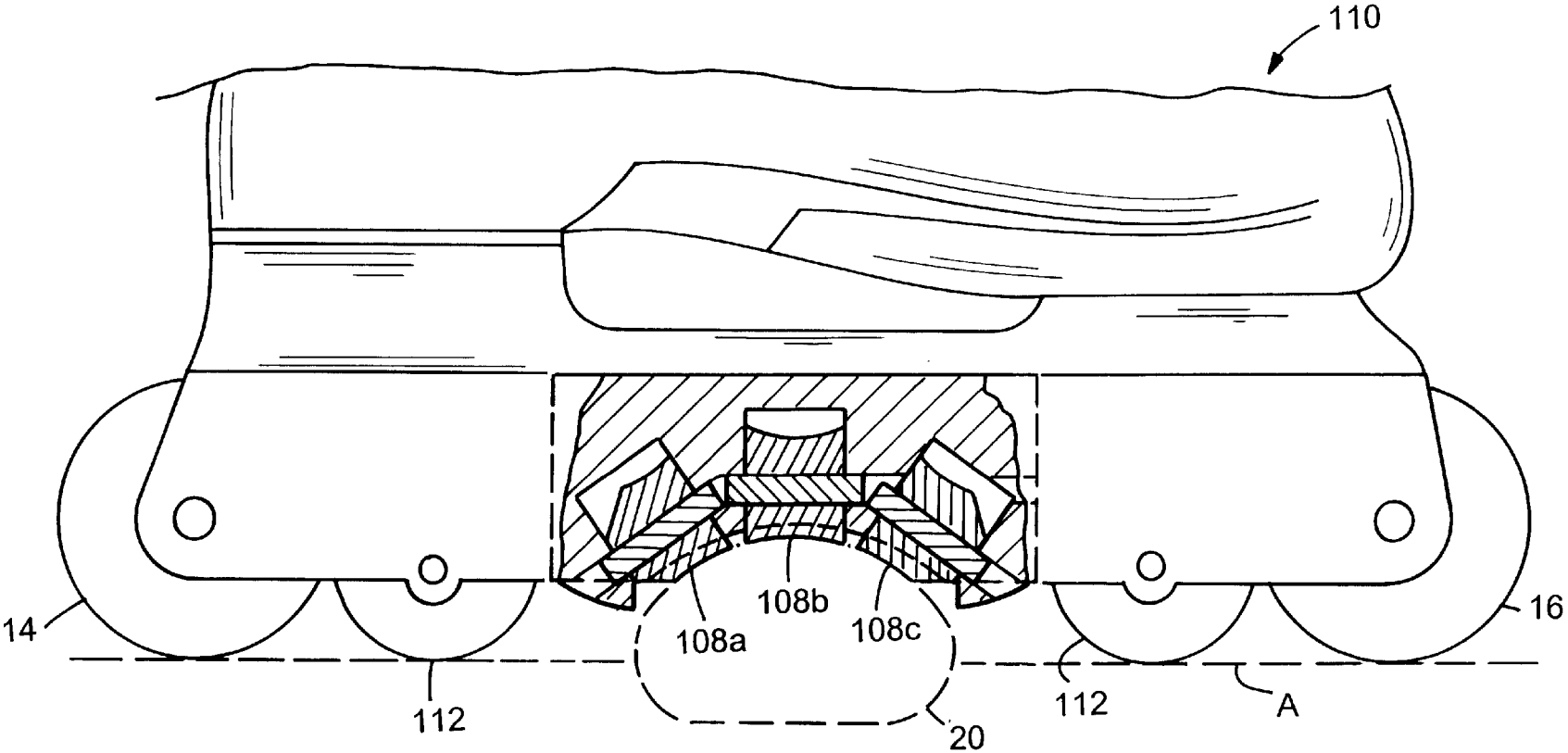
FIG. 15 shows a skate with four wheels and three contoured rollers.

Referring to FIG. 15, rollers 108*a*, 108*b* and 108*c* have outer surfaces which are contoured to conform to the shape of a standard rail, such that the contact load between the rollers and the rail is distributed along the length of the rollers for reduced wear and greater stability. In this instance, all three rollers have concave portions, for rolling along the convex surface of a rail. Skate 110 also has two inner wheels 112 mounted in alignment with wheels 14 and 16, such that all four wheels bear against the ground for forward skating.

Figure 16:
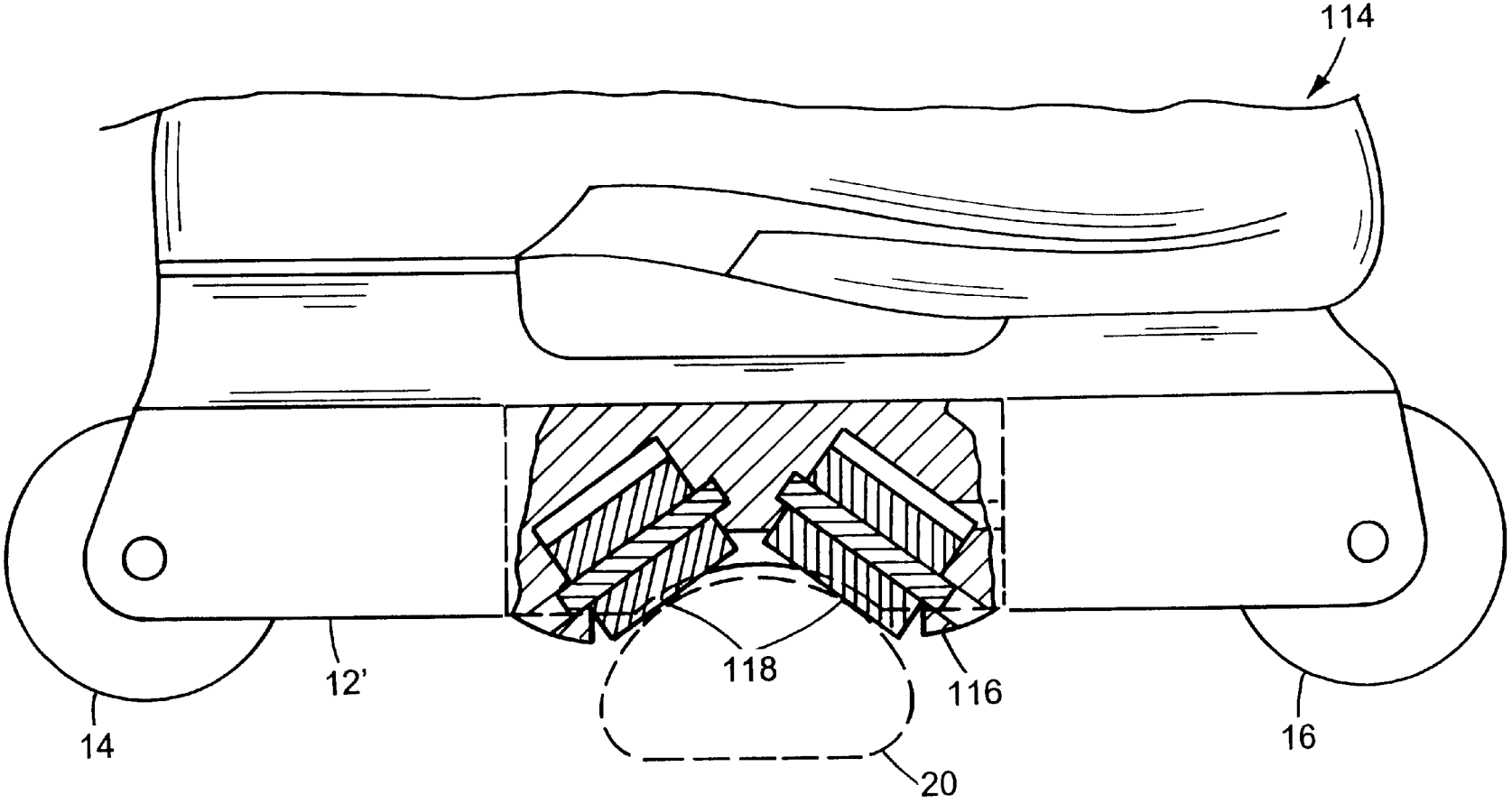
FIG. 16 shows a skate with two cylindrical rollers.

Referring to FIG. 16, skate 114 has a roller block 116 with two cylindrical rollers 118 mounted to simultaneously roll against a rail 20. As in the spherical roller embodiment of FIGS. 5 and 6, rollers 118 define a channel between them through which the rail passes. Rollers 118 may also be contoured to conform to the rail surface.

Figure 17:
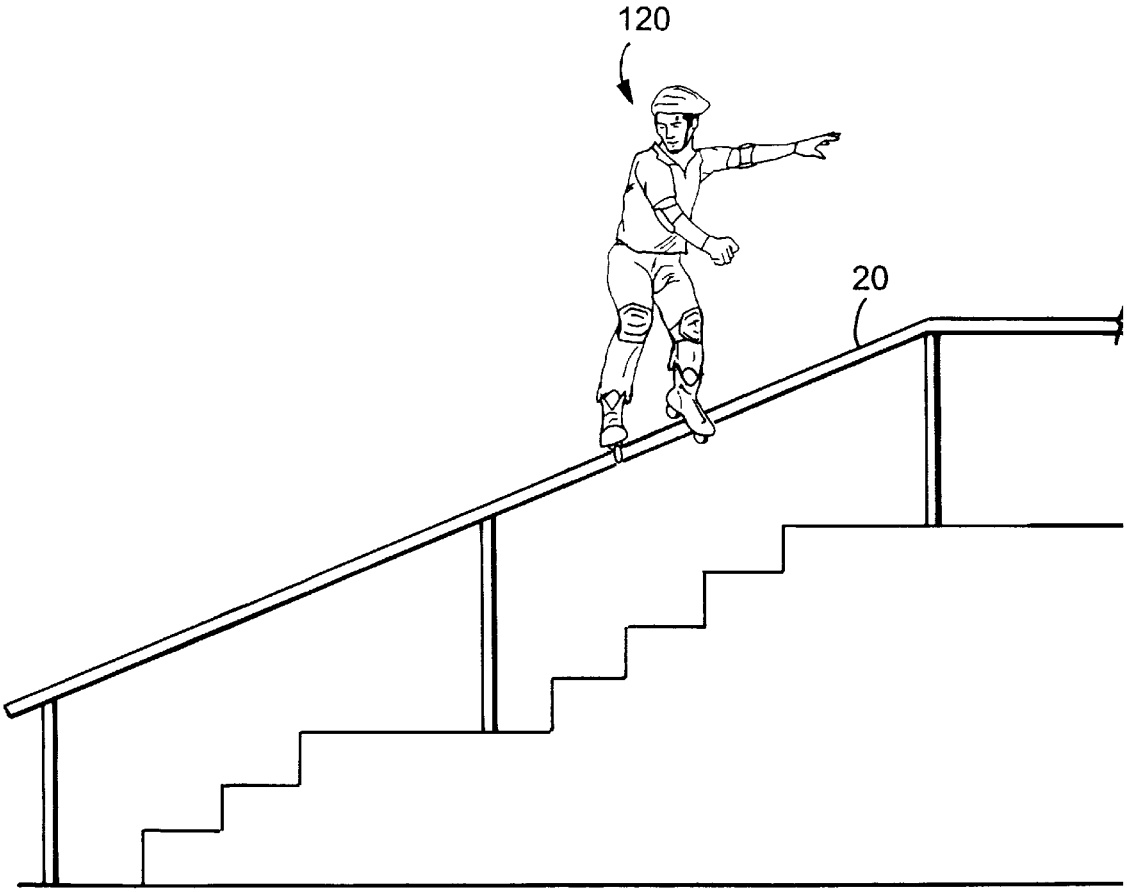
FIG. 17 illustrates a skater skating down a rail with skates constructed according to the invention.

Referring to FIG. 17, a skater 120 is shown rolling down a rail 20 wearing skates constructed with central rollers according to the invention. As shown, the skater is able to maintain a substantially vertical posture with respect to the ground, due to the low friction of the rollers against the rail surface. The skater is also able to achieve and maintain higher speeds through his maneuver due to this advantageously low friction.

Many other embodiments will occur to those skilled in the art, and are within the scope of the following claims.

What is claimed is:

1. An in-line wheeled skate comprising an elongated frame having a longitudinal axis extending in a longitudinal direction of travel of the skate;

at least two wheels positioned in-line along the frame for rotation about axes extending perpendicular to the longitudinal axis of said frame, the wheels adapted to roll in the longitudinal direction of the frame upon a ground plane defined by lowermost portions of the wheels; and at least two longitudinally spaced rotatable rollers positioned between two of the wheels, each roller being mounted to the frame for rotation about a single rotational axis disposed between left and right lateral sides of the wheels, the rotational axis of at least one of the rollers extending at an oblique angle to the longitudinal axis of the frame and to the rotational axis of another of the rollers, each of two of the rollers having an outer engagement surface configured for simultaneous rolling contact with a single elongated supporting surface extending transversely to the longitudinal axis of the frame and between the wheels for permitting the skate to travel in a direction extending perpendicular to the longitudinal direction of said frame, a lowermost portion of the outer engagement surface of each roller being positioned vertically higher than the ground plane of the wheels.

2. The in-line skate of claim 1 further comprising a third roller positioned between the pair of wheels and disposed completely above the ground plane of the wheels, all three rollers having outer engagement surfaces configured for simultaneous rolling contact with a single elongated supporting surface extending transversely between the pair of wheels.

3. The in-line wheeled skate of claim 1 wherein the rollers are cylindrical.

4. The in-line wheeled skate of claim 1 wherein the rollers are contoured in conformation with the elongated supporting surface.

5. The in-line wheeled skate of claim 1 wherein the rollers are centered between left and right longitudinal side planes defined by left and right lateral sides of the wheels.

6. The in-line wheeled skate of claim 1 comprising four wheels, the rollers being disposed between a central pair of the wheels.

7. The in-line wheeled skate of claim 1 further comprising a brake adapted to bear against at least one said roller to resist rotation of the roller.

8. A in-line wheeled skate comprising an elongated frame having a longitudinal axis extending in a longitudinal direction of travel of the skate;

at least two wheels positioned in-line along the frame for rotation about axes extending perpendicular to the longitudinal axis of said frame, the wheels adapted to roll in the longitudinal direction of the frame upon a ground plane defined by lowermost portions of the wheels; and at least two rotatable rollers positioned between a single pair of the wheels and disposed completely above the ground plane of the wheels, each roller being mounted to the frame for rotation about a single rotational axis extending parallel to the longitudinal axis of the frame and laterally spaced from the rotational axis of another of the rollers, each of two of the rollers having an outer engagement surface configured and arranged to enable simultaneous rolling engagement of said two of the rollers along a single elongated supporting surface extending perpendicularly to the longitudinal axis of the frame and between said pair of the wheels, for permitting the skate to travel in a direction perpendicular to the longitudinal axis of the frame.

9. The in-line wheeled skate of claim 8 wherein the rollers are contoured in conformation with the elongated supporting surface.

10. The in-line wheeled skate of claim 8 wherein said frame comprises a primary frame structure carrying said wheels; and a secondary frame structure, releasably attached to the primary frame structure, carrying at least one of said rollers.

11. The in-line wheeled skate of claim 10 wherein said secondary frame structure carries both said rollers.

12. The in-line wheeled skate of claim 8 comprising four wheels, the rollers being disposed between a central pair of the wheels.

13. The in-line wheeled skate of claim 8 comprising four wheels, the rollers being disposed on either side of a central pair of the wheels.

14. An in-line wheeled skate comprising an elongated frame having a longitudinal axis extending in a longitudinal direction of travel of the skate;

at least two wheels positioned in-line along the frame for rotation about axes extending perpendicular to the longitudinal axis of said frame, the wheels adapted to roll in the longitudinal direction of the frame upon a ground plane defined by lowermost portions of the wheels; and two longitudinally spaced roller balls positioned between a pair of the wheels and disposed completely above the ground plane of the wheels, each roller ball being retained within a respective seat of the frame by a retainer defining an opening therethrough, one said retainer opening being set at an oblique angle to another said retainer opening such that the roller balls define an indentation therebetween, the roller balls configured for, and arranged to enable, simultaneous rolling contact with a single elongated supporting surface extending transversely to the longitudinal axis of the frame and through the indentation between said roller balls, for permitting the skate to travel in a direction extending perpendicular to the longitudinal direction of the frame.

15. The in-line wheeled skate of claim 14 wherein the roller balls are spherical.

16. The in-line wheeled skate of claim 14 wherein the roller balls are elliptical.

17. The in-line wheeled skate of claim 14 wherein centers of the spherical rollers are disposed between left and right longitudinal side planes defined by left and right lateral sides of the wheels.

* * * * *